US008262417B1

(12) United States Patent
Wang et al.

(10) Patent No.: US 8,262,417 B1
(45) Date of Patent: Sep. 11, 2012

(54) ELECTRICAL CONNECTOR

(75) Inventors: Yao-Ting Wang, New Taipei (TW); Yu-Hung Su, New Taipei (TW)

(73) Assignee: Cheng Uei Precision Industry Co. Ltd., New Taipei (TW)

( * ) Notice: Subject to any disclaimer, the term of this patent is extended or adjusted under 35 U.S.C. 154(b) by 0 days.

(21) Appl. No.: 13/210,472

(22) Filed: Aug. 16, 2011

(51) Int. Cl.
*H01R 24/00* (2011.01)

(52) U.S. Cl. ..... 439/660

(58) Field of Classification Search ..... 439/660, 439/607.01, 0.07, 0.13, 0.23, 0.35, 0.4, 0.55, 439/541.5, 540.1, 901, 904
See application file for complete search history.

(56) References Cited

U.S. PATENT DOCUMENTS 7,837,506 B1 * 11/2010 Chiang et al. ..... 439/607.27
8,052,467 B1 * 11/2011 Xie et al. ..... 439/589
8,113,865 B1 * 2/2012 Yang et al. ..... 439/353

* cited by examiner

*Primary Examiner* — Edwin A. Leon
*Assistant Examiner* — Harshad Patel
(74) *Attorney, Agent, or Firm* — WPAT, P.C.; Anthony King

(57) ABSTRACT

An electrical connector includes an insulating housing, a dielectric body, a plurality of conductive terminals and a metallic piece. The insulating housing has a top wall, a bottom wall, a rear wall and two opposite side walls which together define an accommodating space thereamong. Two sides of a bottom of the top wall define two receiving grooves. The dielectric body has a base portion fastened in the rear wall, and a tongue portion penetrating forward through the rear wall to be inserted in the accommodating space. The conductive terminals are disposed in the dielectric body. The metallic piece has a base plate molded in the top wall. Two sides of the base plate respectively define an opening corresponding to the receiving groove. A front side of the opening is slantwise bent upward to form a clipping portion located in the receiving groove.

6 Claims, 4 Drawing Sheets

ELECTRICAL CONNECTOR

BACKGROUND OF THE INVENTION

1. Field of the Invention

The present invention generally relates to an electrical connector, and more particularly to an electrical connector used in a communication device having an antenna therein.

2. The Related Art

With fast development of information industry, communication devices have been widely used in people's work and daily life. Various electrical connectors matched with the communication devices have become an irreplaceable position in the communication devices which have antennas. The electrical connector used in the matched communication device usually includes an insulating housing, a plurality of conductive terminals received in the insulating housing and a shielding shell enclosing the insulating housing together with the conductive terminals. However, the electrical connector having the shielding shell surrounded therearound usually occupies a larger space in the communication device, and moreover, an electromagnetic interruption often happens between the shielding shell of the electrical connector and the antenna which are used in the communication device. Especially, when the electrical connector is positioned near the antenna, a normal function of the antenna will be affected by the shielding shell.

SUMMARY OF THE INVENTION

An object of the present invention is to provide an electrical connector adapted to be engaged with a mated connector. The electrical connector includes an insulating housing, a dielectric body, a plurality of conductive terminals and a metallic piece. The insulating housing has a top wall, a bottom wall, a rear wall and two opposite side walls which together define an accommodating space thereamong. Two sides of a bottom of the top wall define two receiving grooves communicating with the accommodating space. The dielectric body has a base portion, and a tongue portion protruded from a front of the base portion. The tongue portion penetrates forward through the rear wall to be inserted into the accommodating space of the insulating housing, and the base portion is fastened in the rear wall. The conductive terminals are disposed in the dielectric body. The conductive terminal has a contact arm exposed in the accommodating space, and a soldering portion hung under the base portion and further stretched under the rear wall of the insulating housing. The metallic piece has a base plate of which two opposite sides and a rear are molded in the insulating housing to make the base plate abut against the bottom of the top wall and apart suspended over the tongue portion of the dielectric body. Two sides of the base plate respectively define an opening corresponding to the receiving groove. A front side of the opening is slantwise bent upward to form a clipping portion located in the receiving groove for securing the mated connector in the accommodating space of the electrical connector.

As described above, the electrical connector uses the design of the metallic piece being molded in the insulating housing to replace a conventional design of a shielding shell being surrounded around a traditional insulating housing as shown in the related art, so that not only can reduce an occupied space by the electrical connector in a communication device (shown in the prior art), but also can effectively weaken an electromagnetic interruption affected on an antenna of the communication device (shown in the prior art).

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
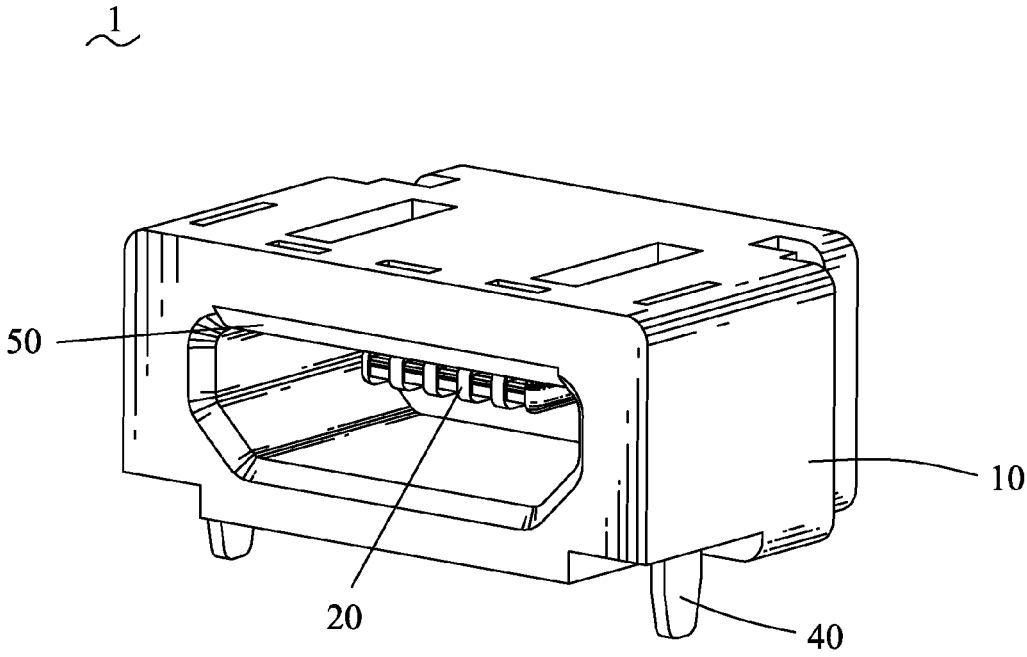
FIG. 1 is a perspective view of an electrical connector in accordance with the present invention.
Figure 2:
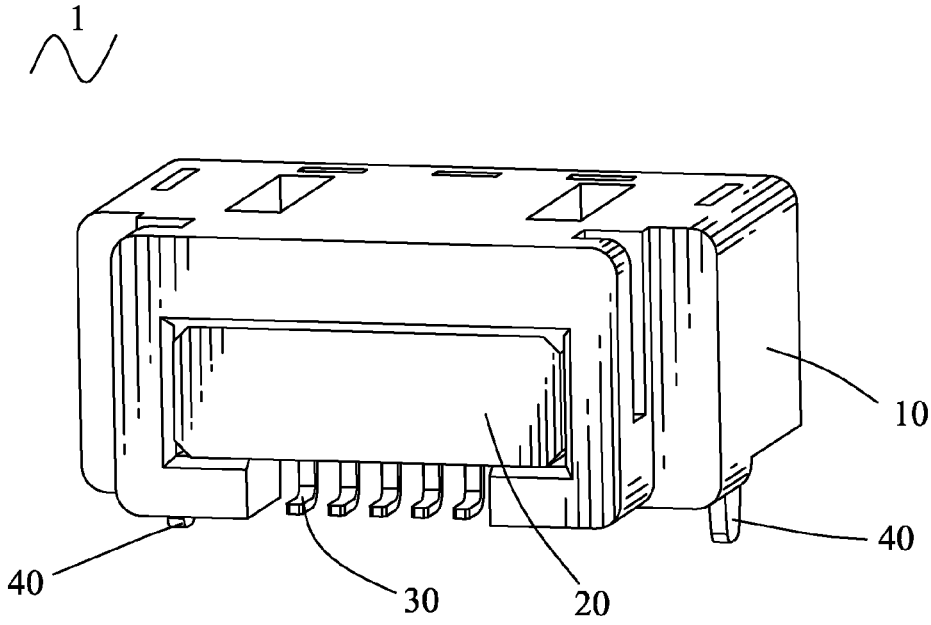
FIG. 2 is another angle of perspective view of the electrical connector of FIG. 1.

With reference to FIG. 1 and FIG. 2, an electrical connector 1 in accordance with the present invention is shown. The electrical connector 1 adapted to be engaged with a mated connector (not shown) generally includes an insulating housing 10, a dielectric body 20, a plurality of conductive terminals 30, two clipping elements 40 and a metallic piece 50.

Figure 3:
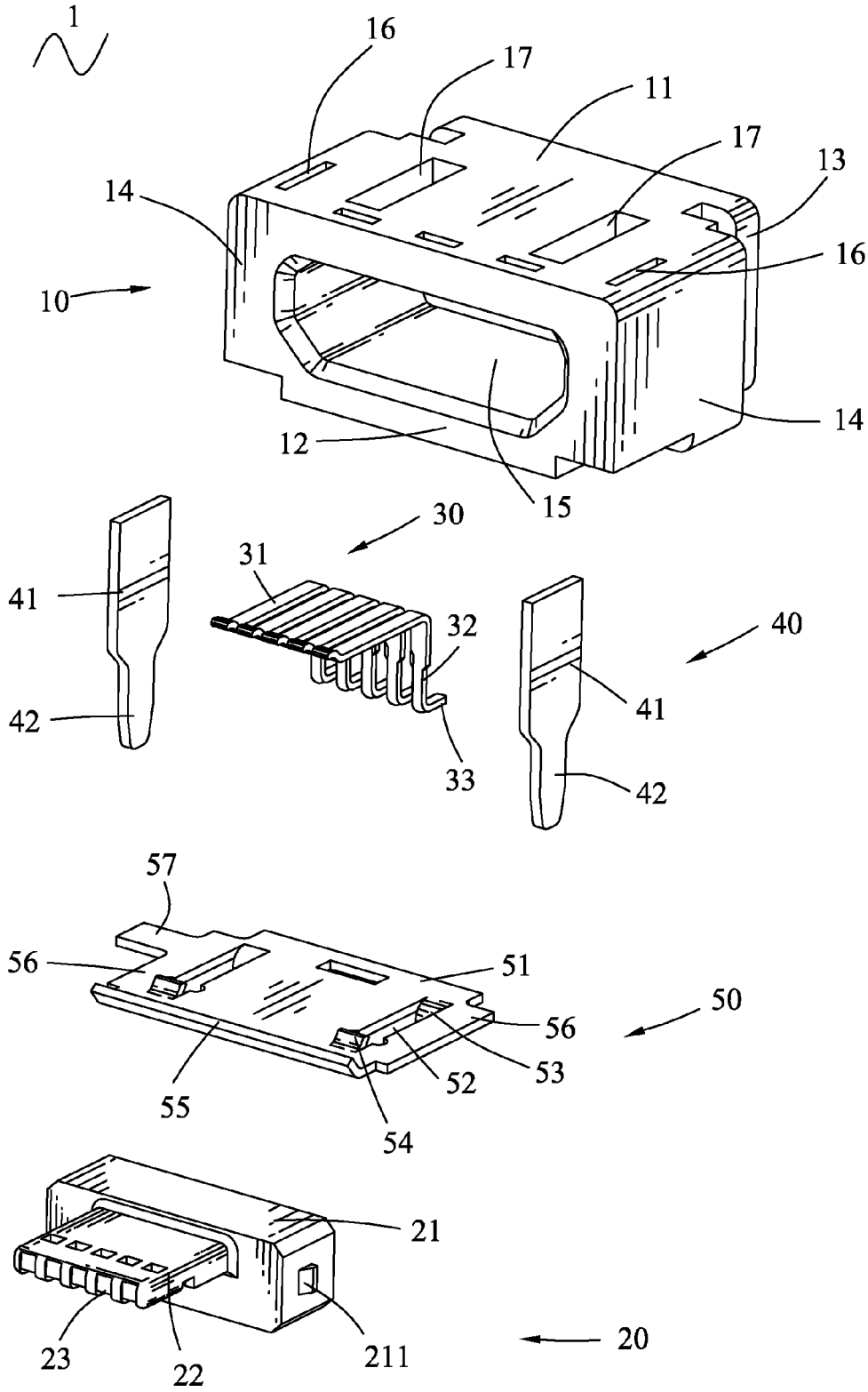
FIG. 3 is an exploded view of the electrical connector of FIG. 1.
Figure 4:
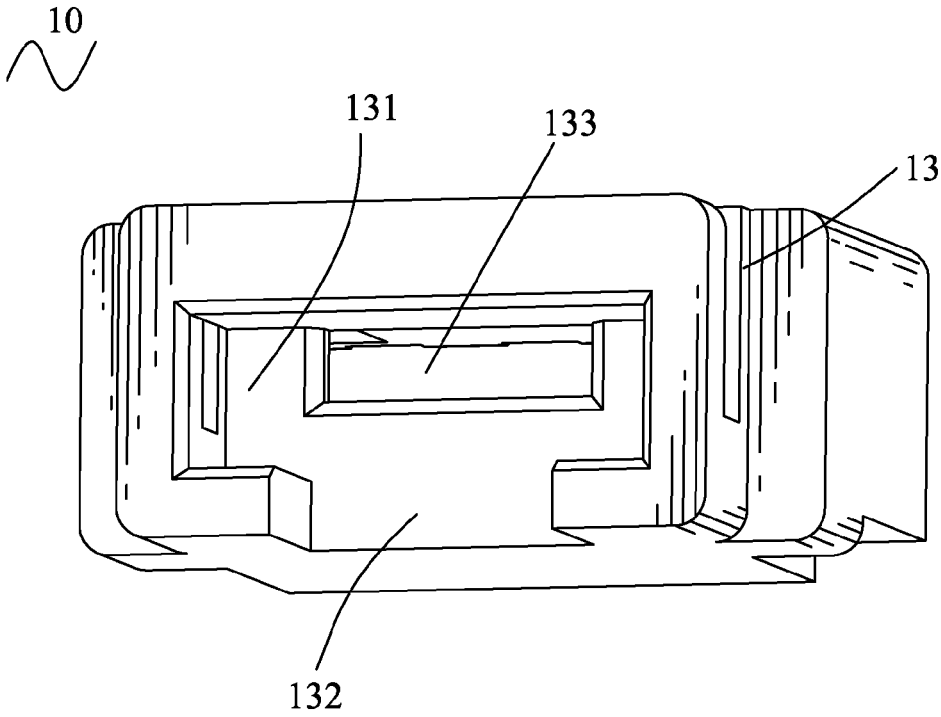
FIG. 4 is a perspective view of an insulating housing of the electrical connector of FIG. 1.
Figure 5:
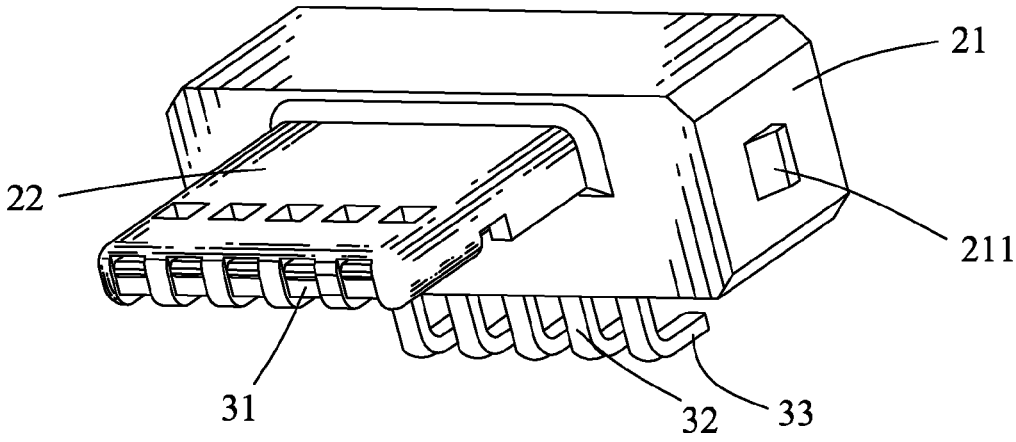
FIG. 5 is an assembled view of a dielectric body and conductive terminals of the electrical connector of FIG. 1.
Figure 6:
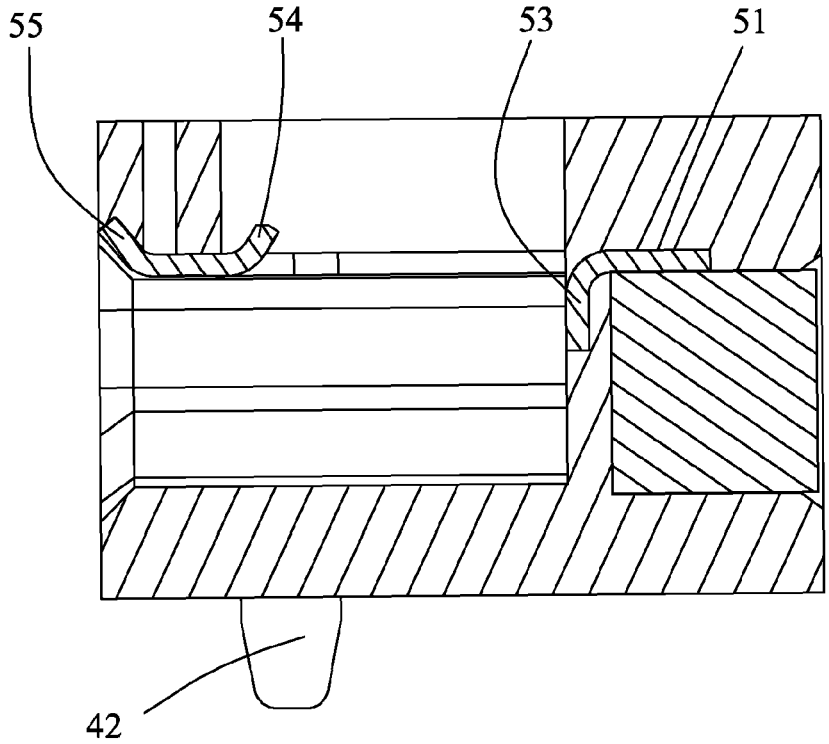
FIG. 6 is a longitudinal cross-sectional view showing that a metallic piece is assembled in the insulating housing of FIG. 1.
Figure 7:
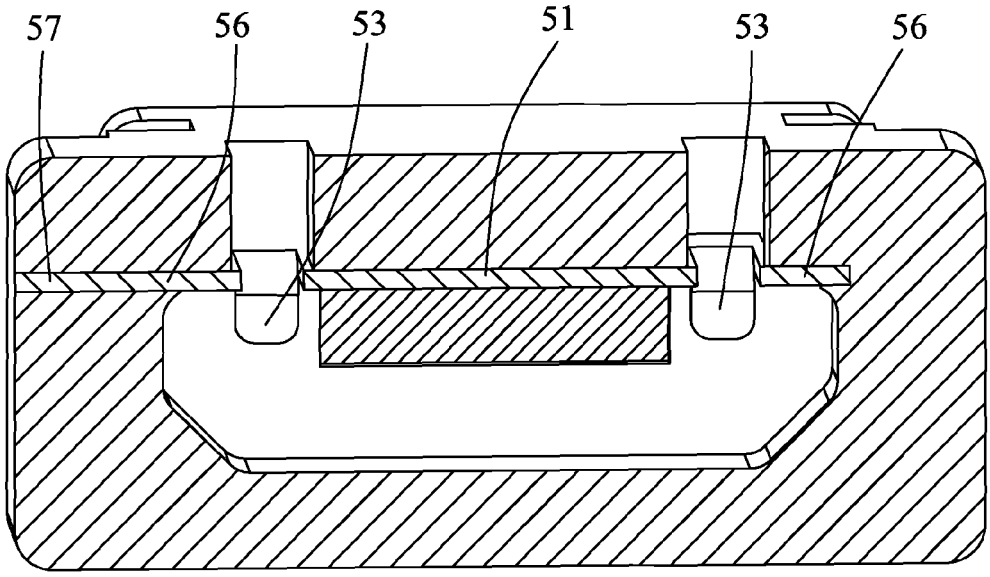
FIG. 7 is a transverse sectional view showing that the metallic piece is assembled in the insulating housing of FIG. 1.

Referring to FIG. 3 and FIG. 4, the insulating housing 10 of a substantial rectangular shape has a top wall 11, a bottom wall 12, a rear wall 13 and two opposite side walls 14. The top wall 11, the bottom wall 12, the rear wall 13 and the two side walls 14 are interconnected to form an accommodating space 15 thereamong. Each of the side walls 14 defines a clipping groove 16 vertically penetrating through the corresponding side wall 14. Two sides of the top wall 11 respectively define a receiving groove 17 longitudinally extending and vertically penetrating through the top wall 11 to communicate with the accommodating space 15. A middle of a rear of the rear wall 13 defines a locating groove 131 of which a middle of a bottom extends downward to form a passage 132 penetrating through a bottom of the rear wall 13. A substantial middle of a front of the rear wall 13 defines an inserting groove 133 communicating between the locating groove 131 and the accommodating space 15.

Referring to FIG. 3, the dielectric body 20 has a rectangular base portion 21 and a tongue portion 22 protruding forward from a middle of a front of the base portion 21. A bottom of the tongue portion 22 defines a plurality of terminal grooves 23 arranged at regular intervals along a transverse direction thereof. A front of the terminal groove 23 is further spread to a front side of the tongue portion 22 and a rear of the terminal groove 23 vertically penetrates through a bottom of the base portion 21. Two opposite sides of the base portion 21 protrude oppositely to from two clipping blocks 211.

Referring to FIG. 3, each of the conductive terminals 30 has an elongated contact arm 31. One end of the contact arm 31 extends downward to form a connecting portion 32. A bottom end of the connecting portion 32 extends towards a direction opposite to the contact arm 31 to form a soldering portion 33. The clipping element 40 has a rectangular boardshaped fastening portion 41 placed vertically, and an inserting portion 42 extended downward from a middle of a bottom of the fastening portion 41.

Referring to FIG. 3, the metallic piece 50 has a rectangular base plate 51. Two sides of the base plate 51 respectively define an opening 52 extending along a front-to-rear direction of the base plate 51. A rear side of the opening 52 is bent downward and extends vertically to form a blocking portion 53. A front side of the opening 52 is slantwise bent upward to form an arc-shaped clipping portion 54. A front side of the base plate 51 is slantwise arched upward to form a long and narrow guiding piece 55. Two opposite ends of the base plate 51 oppositely extend outward to form two flanks 56. An outer side edge of one flank 56 further extends outward to form an extending piece 57.

Referring to FIGS. 1-7, the conductive terminals 30 are integrally molded in the dielectric body 20, with the contact arms 31 being embedded in the terminal grooves 23 and exposed beyond the bottom of the tongue portion 22. The connecting portion 32 is vertically embedded in the base portion 21 to make the soldering portion 33 hung under the base portion 21. The metallic piece 50 and the insulating housing 10 are molded together in an injection mold, with the flanks 56, the extending piece 57 and a rear of the base plate 51 being embedded in the insulating housing 10 to make a top side of the base plate 51 abut against a bottom side of the top wall 11. The openings 52 face the receiving grooves 17 respectively, with the clipping portion 54 stretching in the corresponding receiving groove 17 for securing the mated connector in the accommodating space 15 of the electrical connector 1, and the blocking portion 53 being embedded in a front side of the rear wall 13 and exposed to the accommodating space 15. The guiding piece 55 wraps a bottom edge of a front end of the top wall 11 for guiding the mated connector to be inserted into the accommodating space 15 of the electrical connector 1. Then, assemble the dielectric body 20 together with the conductive terminals 30 to the insulating housing 10 with the tongue portion 22 being inserted forward into the accommodating space 15 through the locating groove 131 and the inserting groove 133. The contact arm 31 of the conductive terminal 30 is exposed in the accommodating space 15. The base plate 51 of the metallic piece 50 is apart suspended over the tongue portion 22 of the dielectric body 20. The base portion 21 is fastened in the locating groove 131 by virtue of the two clipping blocks 211 resisting against inner sides of the locating groove 131. The soldering portions 33 pass through the passage 132 to be stretched under the rear wall 13 of the insulating housing 10 so as to be soldered on a printed circuit board (not shown). The fastening portion 41 of the clipping element 40 is fastened in the clipping groove 16. The inserting portion 42 stretches out of a bottom of the clipping groove 16 to be inserted into the printed circuit board so as to secure the electrical connector 1 with the printed circuit board firmly.

As described above, the electrical connector 1 uses the design of the metallic piece 50 being molded in the insulating housing 10 to replace a conventional design of a shielding shell being surrounded around a traditional insulating housing as shown in the related art, so that not only can reduce an occupied space by the electrical connector 1 in a communication device (shown in the prior art), but also can effectively weaken an electromagnetic interruption affected on an antenna of the communication device (shown in the prior art).

What is claimed is:

1. An electrical connector adapted to be engaged with a mated connector, comprising:

an insulating housing having a top wall, a bottom wall, a rear wall and two opposite side walls which together define an accommodating space thereamong, two sides of a bottom of the top wall defining two receiving grooves communicating with the accommodating space;

a dielectric body having a base portion, and a tongue portion protruded from a front of the base portion, the tongue portion penetrating forward through the rear wall to be inserted into the accommodating space of the insulating housing, and the base portion being fastened in the rear wall;

a plurality of conductive terminals disposed in the dielectric body, the conductive terminal having a contact arm exposed in the accommodating space, and a soldering portion hung under the base portion and further stretched under the rear wall of the insulating housing; and a metallic piece having a base plate of which two opposite sides and a rear are molded in the insulating housing to make the base plate abut against the bottom of the top wall and apart suspended over the tongue portion of the dielectric body, two sides of the base plate respectively defining an opening corresponding to the receiving groove, a front side of the opening being slantwise bent upward to form a clipping portion located in the receiving groove for securing the mated connector in the accommodating space of the electrical connector.

2. The electrical connector as claimed in claim 1, wherein a rear side of the opening is bent downward and extends vertically to form a blocking portion embedded in a front side of the rear wall and exposed in the accommodating space.

3. The electrical connector as claimed in claim 1, wherein a front side of the base plate is arched upward and forward to form a guiding piece wrapping a bottom edge of a front end of the top wall for guiding the mated connector to be inserted into the accommodating space of the insulating housing.

4. The electrical connector as claimed in claim 1, wherein the two opposite sides of the base plate of the metallic piece oppositely extend sideward to form two flanks embedded in the two side walls respectively.

5. The electrical connector as claimed in claim 4, wherein an outer side edge of one flank extends sideward to form an extending piece further molded in the corresponding side wall.

6. The electrical connector as claimed in claim 1, further comprising two clipping elements, the clipping element includes a fastening portion fastened in the side wall, and an inserting portion extended downward from a bottom of the fastening portion and projected under the side wall of the insulating housing.

* * * * *